United States Patent [19]

Schewe

[11] 3,990,219

[45] Nov. 9, 1976

[54] COMBINATION STRUCTURAL BACKBONE AND AIR DUCT

[75] Inventor: Richard A. Schewe, Rockford, Ill.

[73] Assignee: Barber-Colman Company, Rockford, Ill.

[22] Filed: June 11, 1975

[21] Appl. No.: 585,969

[52] U.S. Cl. ..... 57/1 R; 57/58.89

[51] Int. Cl.[2] ..... D01H 11/00

[58] Field of Search ..... 57/1 R, 34 R, 58.89–58.95, 57/56, 136

[56] References Cited

UNITED STATES PATENTS

| | | | |
|---|---|---|---|
| 2,923,119 | 2/1960 | Nifenecker | 57/1 R |
| 3,103,095 | 9/1963 | Keyser | 57/1 R |
| 3,381,458 | 5/1968 | Rajnoha et al. | 57/1 R |
| 3,627,584 | 12/1971 | Stewart | 57/58.89 X |
| 3,762,143 | 10/1973 | Stewart | 57/56 |
| 3,774,382 | 11/1973 | Bartling | 57/1 R |
| 3,782,095 | 1/1974 | Bures et al. | 57/56 |
| 3,936,995 | 2/1976 | Laflaguiere et al. | 57/1 R |

*Primary Examiner*—Donald E. Watkins
*Attorney, Agent, or Firm*—A. Richard Koch

[57] ABSTRACT

An open end spinning machine employs a tubular member serving as an air duct and upon which the spinning and winding components are mounted.

14 Claims, 4 Drawing Figures

COMBINATION STRUCTURAL BACKBONE AND AIR DUCT

BACKGROUND OF THE INVENTION

This invention relates to machines for spinning textile fibers by the open end method, whereby fibers are fed into a cavity of a spinning rotor, where they are spun into thread. A typical open end spinning unit is described in U.S. Pat. No. 3,807,157, issued Apr. 30, 1974 to Fritz Stahlecker. More particularly this invention relates to an open end spinning machine in which a plurality of spinning units, their associated winding units and auxiliary components are mounted upon and structurally supported by a rigid backbone extending longitudinally between ends of the machine, as described in my copending patent application Ser. No. 585,968, filed on June 11, 1975. Such machines employ a vacuum system connected to the spinning chamber and sometimes to a cleaning chamber in each spinning unit. In the usual construction one duct extending the length of the machine is connected between a vacuum producing source and each of the spinning chambers, while another duct extending the length of the machine is connected between another vacuum producing source and each of the cleaning chambers. Different vacuum sources are employed because of the difference in vacuum pressures employed.

SUMMARY OF THE INVENTION

This invention combines at least one of the ducts with the backbone. The resulting structure has fewer components and is more rigid.

DESCRIPTION OF THE PREFERRED EMBODIMENT

Figure 1:
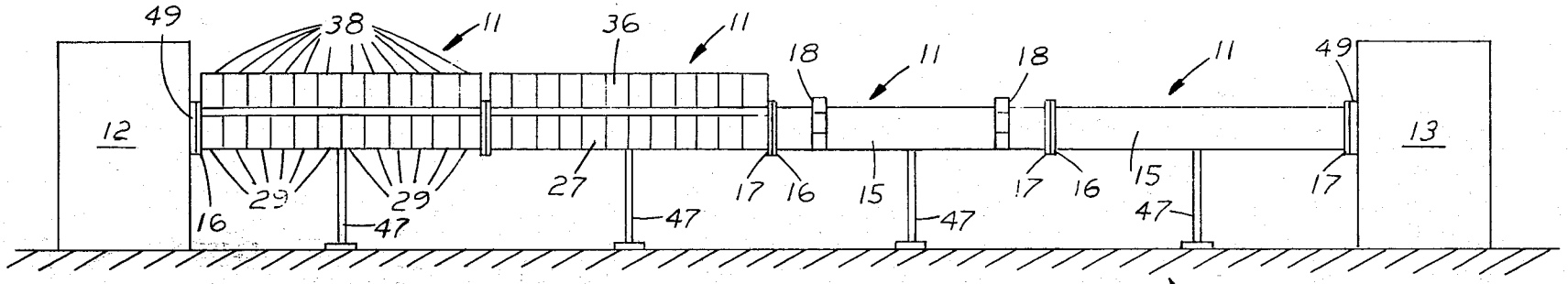
FIG. 1 is a longitudinal elevation of one embodiment of an open end spinning machine according to this invention, said machine having components broken away to demonstrate construction.

In a preferred embodiment of this invention shown in the drawings, an open end spinning machine 10 comprises a plurality of intermediate modular sections 11 in end-to-end aligned relation between end sections 12, 13, as shown in FIG. 1.

Figure 2:
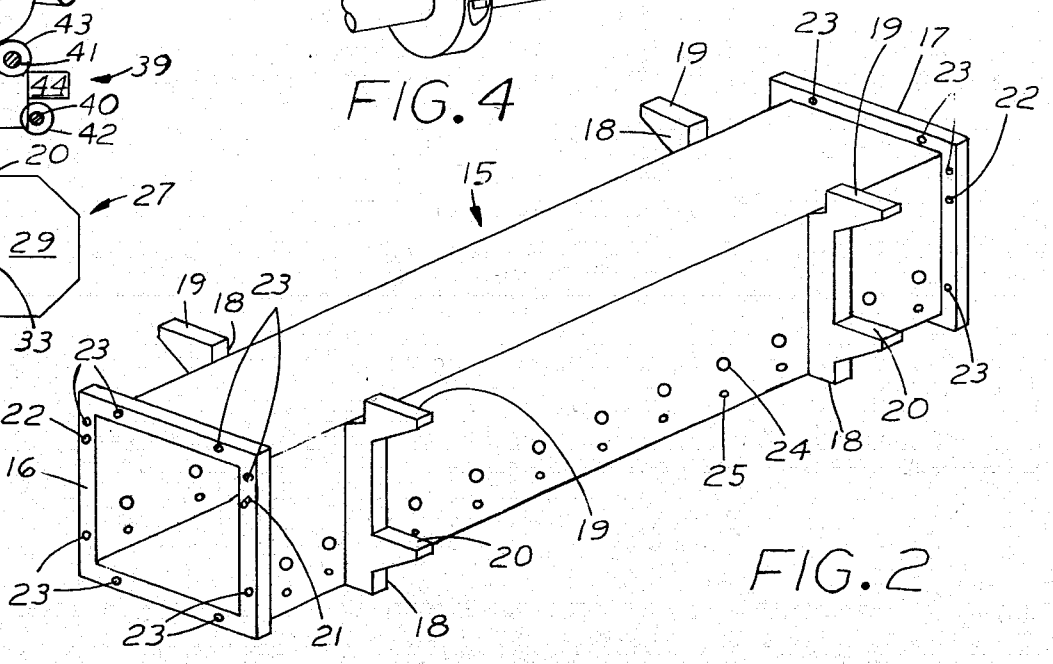
FIG. 2 is a perspective view of a backbone employed in the embodiment shown in FIG. 1.

Each modular section 11 comprises an elongated rigid tubular backbone 15 with flat flanges 16, 17 perpendicular to the longitudinal axis of the backbone at the ends thereof and a plurality of brackets 18 affixed in accurately predetermined positions on opposite sides thereof, as best seen in FIG. 2. Each bracket has upper and lower supporting surfaces 19 and 20 respectively. The flanges 16, 17 are flat and perpendicular to the longitudinal axis of the backbone 15 so that, when the flanges of adjacent end-to-end backbones are connected together, the end-to-end backbones will be in substantially perfect longitudinal alignment. Locating pins 21 in at least one of the flanges 16, 17 are snugly received in correspondingly located receiving holes 22 in the other of the flanges 16, 17 of the adjacent backbone 15 to assure accurate lateral alignment of the backbone. Clearance holes 23 in corresponding positions on the flanges 16, 17 receive bolts to fasten adjacent flanges rigidly together and thus connect the aligned backbones 15 into a rigid structure between the end sections 12, 13. Two holes 24, 25 for each spinning unit to be supported on the backbone are provided in the sides of the tubular backbone for purposes to be explained later.

Spinning bays or sub-assemblies 27 are supported by and bolted to the lower supporting surfaces 20 on opposite sides of the backbone 15. Each spinning sub-assembly comprises an elongated rigid support, shown as a channel box 28, housing apparatus, such as is shown and described in Stahlecker U.S. Pat. No. 3,779,620 issued on Dec. 18, 1973, for driving spinning rotors (now shown) in a plurality of open end spinning units 29 mounted at predetermined spaced spinning stations on the channel box. The spinning units may be of the type shown and described in my copending patent application Ser. No. 578,352, filed on May 16, 1975. The channel box 28 is usually the same length as the backbone 15 and is the portion of the spinning sub-assembly 27 resting upon and bolted to the supporting surfaces 20. A driving mechanism 30, comprising feed and opening drive shafts 31, 32 respectively delivering power through appropriate mechanism to feed and opening rolls (not shown) in the spinning unit 29, is joined to the channel box 28. The spinning chamber (not shown) in the spinning unit 29 is connected by a tube 33 to a duct drawing air from the spinning chamber to provide a partial vacuum therein. In this embodiment the tubular backbone 15 doubles as the duct with tube 33 connected to it through hole 24. A second tube 34 connects the cleaning chamber (not shown) in spinning unit 29 to a duct drawing air and trash by a partial vacuum from the cleaning chamber. In this embodiment the tubular backbone 15 also serves as the second duct with tube 34 connected to it through hole 25. The employment of a single duct to produce both partial vacuums is made possible by the teachings of my aforesaid copending application Ser. No. 578,352, filed on May 16, 1975. The shafts 31, 32 and the ducts (if separate ducts are employed) in the spinning sub-assemblies 27 must be substantially the same length as and coextensive with the backbone 15 upon which the sub-assemblies are mounted.

Winding bays or sub-assemblies 36 are supported by and bolted to the upper supporting surfaces 19 on opposite sides of the backbone 15. Each winding sub-assembly comprises an elongated rigid support, shown as a beam 37, upon which is mounted a plurality of winding units 38, equal in number to and aligned with the spinning units 29 mounted on the channel box 28. Driving apparatus 39, comprising withdrawal and package drive shafts 40, 41 respectively delivering power to withdrawal rolls 42 and to package drive rolls 43 and traversing mechanism 44, is connected to the beam 37. The drive shafts 41, 42 are of substantially the same length as the backbone 15. There is a withdrawal roll 42, a traverse mechanism 44, which is in accord with the teachings of a copending patent application Ser. No. 558,657 filed on Mar. 17, 1975 by Frank L. Townsend and myself, and a package drive roll 43 for each winding unit 38. A package support 45 for each winding unit is pivotally mounted on the beam 37 so that a package 46 supported thereby is positioned to rest upon and be driven by a respective package drive roll 43.

The spinning sub-assemblies 27 and the winding sub-assemblies 36 are handled as unitary components when they are placed upon and bolted to the lower and upper supporting surfaces 20, 19 respectively in the preferred embodiment. It will be obvious however that sub-assemblies are only convenient and not a necessity. The components comprising the sub-assemblies could be affixed in proper relation to the backbone without first being combined into sub-assemblies. More or fewer sub-assemblies could be provided and the combinations of components in and the functions of the sub-assemblies may be altered as a matter of choice.

Although a tubular backbone 15 is sufficiently rigid to permit the intermediate sections 11 to be supported solely by end sections 12, 13, it is convenient to provide a leg 47 affixed to each backbone 15 to assist in supporting the intermediate sections.

The modular intermediate sections 11 are coextensive in length with the backbone 15 and are complete in themselves aside from connections to power and vacuum sources.

It will be obvious that individual sub-assemblies and drive shafts may be shorter than the backbone upon which they are supported if several such sub-assemblies and shafts can be joined together to produce a combined length substantially equal to that of the backbone. It will also be apparent that the number of drive shafts and ducts may vary as they are combined to provide multiple functions or separated to supply single functions. Regardless of the design, the shafts and ducts serving like functions in the intermediate modular sections must be so mounted on the backbone that they will be in accurate operative alignment when adjacent backbones are joined together. Spinning and winding sub-assemblies may be supported on both sides or only one side of the backbone.

The end sections 12, 13 supply the mechanical power to the drive shafts 31, 32, 40, 41 and to an endless belt (not shown) in channel box 28, and provide a vacuum source for the ducts (backbone 15 in this embodiment). In the preferred embodiment, the end sections 12, 13 are identical, providing power and a vacuum source for the spinning and winding sub-assemblies 27, 36 on respective sides of the backbones 15. End sections 12, 13 also provide pads 49, identical in form to flanges 16, 17, for connection to respective terminal flanges 16, 17 of the string of intermediate sections 11. The pads 49, like the flanges 16, 17 must be flat and perpendicular to the backbones 15 in order to permit the sections 11, 12, 13 to be accurately aligned.

Figure 4:
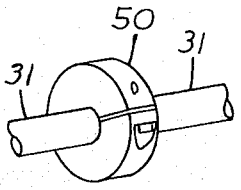
FIG. 4 is a detail of a shaft connection.
Figure 3:
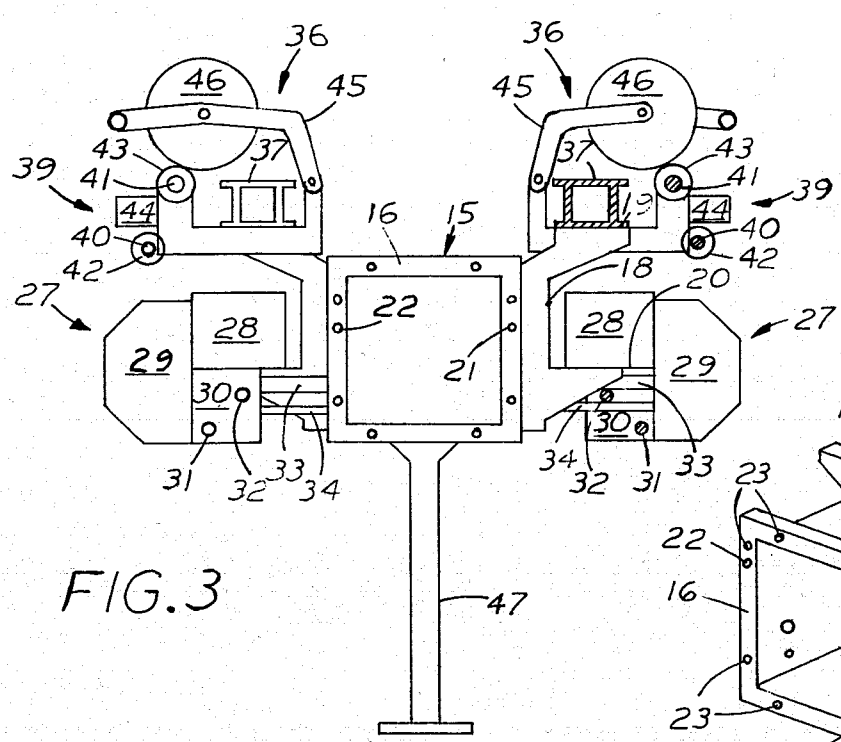
FIG. 3 is an end view of one of the intermediate modular sections assembled on the backbone.

When the open end spinning machine 10 is assembled, the locating pins 21 and receiving holes 22 in adjacent flanges 16, 17 or pads 49, are aligned and the sections 11, 12 or 13 involved are moved toward each other so that the pins 21 enter holes 22 and so accurately position the sections with respect to each other. The flanges and pads are then bolted together to connect the sections into a rigid structure. The respective shafts 31, 32, 40, 41 of the adjacent sections 11 are coupled end-to-end, as by a clamp type couplings 50 shown in FIG. 4. The same type coupling can be employed to connect the respective terminal shafts 31, 32, 40, 41 to the corresponding mechanical power supplies (not shown) in the end sections 12, 13. The vacuum source in the end sections 12, 13 are operatively connected to the backbone to exhaust air therefrom. If ducts separate from the backbone are employed, they are coupled end-to-end and to respective vacuum sources in end sections 12, 13, as by rubber or plastic tubing or by wraps of tape covering the joint. An endless belt (not shown) is inserted into each channel box 28 in driving relation to the spinning rotors (not shown) and engaged with the mechanical power supply (not shown) in an end section 12 or 13, as described in said Stahlecker patent.

The embodiment shown and described is illustrative only. Many modifications will be obvious to those skilled in the art. The scope of this invention is defined by the claims.

I claim:

1. In an open end spinning machine a rigid tubular member having means for structurally supporting an open end spinning unit and means for conducting air from said spinning unit into the member.

2. A member according to claim 1 wherein said air conducting means comprises a hole in a side of the member.

3. A member according to claim 1 wherein said supporting means comprises a bracket.

4. A member according to claim 1 wherein said supporting means is adapted to structurally support a plurality of spinning units.

5. A member according to claim 4 wherein said air conducting means comprises in a side of the member at least one hole for each of said spinning units.

6. A member according to claim 1, said member being elongated.

7. A member according to claim 1, said member comprising at least one opening for exhausting air from the member.

8. In combination, a rigid tubular member, an open end spinning unit structurally supported on said member, and means for conducting air from said spinning unit into the member.

9. A combination according to claim 8 wherein said spinning unit comprises at least one chamber from which air is drawn through said air conducting means.

10. A combination according to claim 9 wherein said chamber is a spinning chamber.

11. A combination according to claim 9 wherein said chamber is a cleaning chamber.

12. A combination according to claim 8 wherein said means for conducting air draws air from each of a spinning chamber and a cleaning chamber in said spinning unit.

13. A combination according to claim 8 wherein said air conducting means comprises a tube.

14. A combination according to claim 8 additionally comprising means for exhausting air from said member.

* * * * *